United States Patent [19]

Conforto et al.

[11] Patent Number: 4,727,708

[45] Date of Patent: Mar. 1, 1988

[54] WRAP-AROUND PACKAGING MACHINE

[75] Inventors: Peter M. Conforto, Monroe, La.; Steven G. Ingram, Ravenna, Ohio

[73] Assignee: Manville Corporation, Denver, Colo.

[21] Appl. No.: 915,456

[22] Filed: Oct. 6, 1986

[51] Int. Cl.[4] ..... B65B 5/06

[52] U.S. Cl. ..... 53/534; 53/209; 53/374

[58] Field of Search ..... 53/461, 491, 534, 374, 53/209

[56] References Cited

U.S. PATENT DOCUMENTS

| | | | |
|---|---|---|---|
| 2,932,929 | 4/1960 | Fafrenbach | 53/209 X |
| 3,555,776 | 1/1971 | Nigrelli | 53/209 X |
| 3,673,763 | 7/1972 | Dorfman | 53/209 X |
| 3,866,392 | 2/1975 | Weeks | 53/534 |
| 4,030,268 | 6/1977 | Payne | 53/534 X |
| 4,343,129 | 8/1982 | Gunther | 53/209 |
| 4,571,916 | 2/1986 | Meuwly | 53/209 X |

*Primary Examiner*—John Sipos

*Attorney, Agent, or Firm*—John D. Lister; Cornelius P. Quinn; Timothy R. Schulte

[57] ABSTRACT

A blank for forming a wrap-around carton is delivered to a moving support carriage which is moved to a station where the moving carriage receives a predetermined number of articles to be packaged. The carriage, with the articles resting on the bottom portion of the blank, is moved downstream while cams actuate tucker fingers which pivot up to fold the tuck flaps of the blank toward each other, causing the end and side panels to be elevated. Another cam actuates a pusher bar which pivots up to push the articles. The carton blank and the articles are thus positively moved through subsequent flap folding and gluing stations, avoiding the problems which can arise due to the use of separate means for moving the articles and the carton blank. A cam operated hinged plate is used to segregate the leading articles at the entry to the machine.

13 Claims, 15 Drawing Figures

A
B
C
D
E
F

WRAP-AROUND PACKAGING MACHINE

FIELD OF THE INVENTION

This invention relates generally to the packaging of articles and in particular to the packaging of articles in a warp-around carton.

BACKGROUND OF THE INVENTION

Aseptic containers have come into greater use in the marketing of beverages and other products. These containers generally have rectangular bases, and their side walls usually include a substantial expanse of flat wall portions. This allows the containers to be packaged in a carton in close side by side relationship with little lost space.

The cartons in which the containers are packaged are normally formed around the containers by a packaging machine while the containers are moving through it. Because the machine must at times form packages holding varying numbers of containers, it has to be capable of segregating from the stream of incoming containers the number of containers intended to be packaged in the particular carton being run through the machine at the time.

An example of a packaging machine designed to perform these functions is disclosed in U.S. Pat. No. 4,571,916, wherein the leading articles of the incoming stream of articles are fed onto a vertically movable plate. The plate lifts the articles up to the level of the support surface of the machine and they are pushed along the support surface by a flight bar conveyor which extends the full length of the machine. The carton blanks are moved along the support surface by a different conveying means. Thus the separate conveying systems for moving the articles and the carton blanks must be moved in timed relationship, which is normally more likely to cause operational and maintenance problems that an arrangement in which a single conveying system controls the movement of both the articles to be packaged and the carton blanks. In addition, the presence of the overhead flight conveyor hinders ready access to the machine for purposes of maintenance or adjustment.

In order to improve and simplify the operation, it would be desirable to develop a machine which does not require the package to move through the machine at a different height than the entry level of the articles and which does not hinder access to the path of travel of the articles. It would also be desirable to have a single conveying means for positively controlling the movement of both the articles to be packaged and the carton blank.

BRIEF SUMMARY OF THE INVENTION

This invention provides a novel arrangement for segregating a predetermined number of articles to be packaged. The articles are then moved from the segregating station to a station where they are deposited on a carton blank resting on a movable support means. The articles rest directly on the portion of the blank designed to be the bottom of the carton. As the support means moves downstream means on the support means fold the leading and trailing tuck flaps toward each other, causing the side and end panels to be elevated. Other means on the support means push the trailing faces of the articles while the support means moves downstream. The flaps are then folded into place and glued in the conventional manner.

These and other features and aspects of the invention, as well as its various benefits, will be made more clear in the detailed description of the invention which follows.

BRIEF DESCRIPTION OF THE DRAWINGS

FIGS. 1A–F are pictorial representations of a carton blank of the type used in packaging aseptic containers, showing in sequence the steps by which the blank is folded in the machine of this invention to form the carton;

DESCRIPTION OF THE INVENTION

Figures 1, 2:
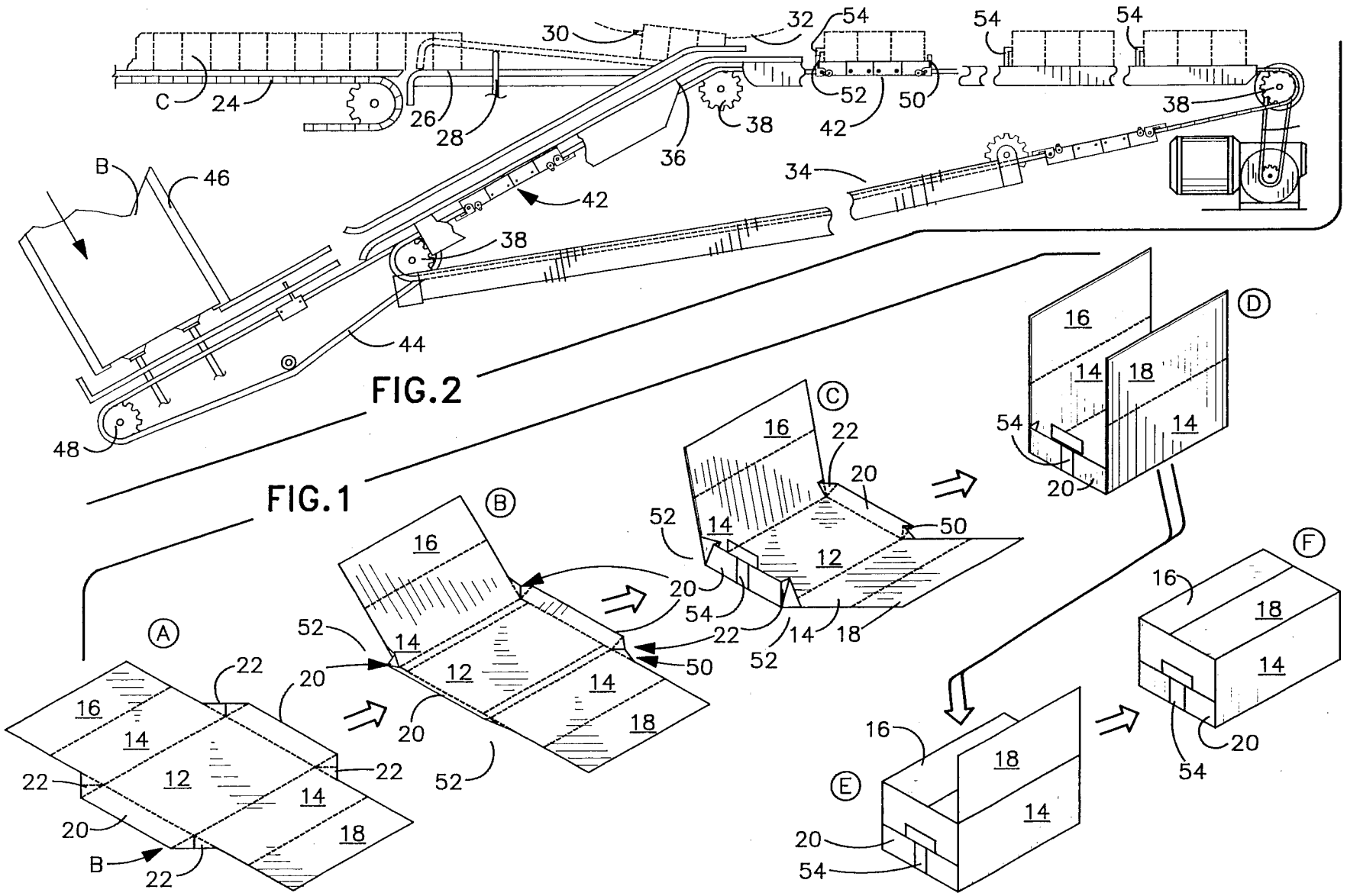
FIG. 2 is a schematic side elevation of the machine showing the major components thereof.

Referring to FIG. 1A, a carton blank B of the type used to form a typical carton for packaging aseptic containers is shown as having a bottom panel 12, side panels 14 foldably connected to the bottom panels, an inner top panel 16 foldably connected to the far side panel 18, an outer top panel foldably connected to the near side panel, and end panels 20 foldably connected to the bottom panel 12. Tuck flaps 22 foldably connect the end panels 20 to the side panels 14.

FIG. 1B illustrates the first step in the folding operation, which consists of beginning to fold the leading and trailing tuck flaps 22 toward each other. As this occurs the end panels 20 begin to be elevated and the side panels 14 begin to be raised toward each other.

When the tuck flaps 22 are folded in against the articles which would be resting on the bottom panel, the panels are in the approximate relative positions shown in FIG. 1C. The leading and trailing end panels 20 are substantially vertically arranged and the side panels 14 are raised up enough to be in position for engagement by folding bars or rails which fold them up to the vertical as shown in FIG. 1D. Other folding bars first fold down the inner top panel 16, as shown in FIG. 1E, and then the outer top panel 18 to form the finished carton shown in FIG. 1F. It is to be understood that these folding steps would take place with articles to be packaged resting on the bottom panel of the carton blank so that by the time the carton has been fully formed, the articles will have been packaged inside it. Articles to be packaged have been omitted from these views for purpose of clarity.

Referring to FIG. 2,the operation of the machine of this invention is shown in schematic form. Aseptic containers C, or other articles to be packaged, are shown being delivered to the machine by infeed conveyor 24. The articles move onto a support plate 26 until they are stopped by engagement with an upstanding lug 28. When this occurs the entire stream of containers being delivered by the conveyor 24 will stop even through the conveyor 24 continues to move, the conveyor simply sliding over the bottom surfaces of the containers. The support plate 26 is then raised to the dotted line position to lift up the containers resting on the support plate. The number of containers on the support plate will have been predetermined by the number of rows of containers being delivered by the conveyor, their dimensions, and the distance between the upstream end of the support plate and the stop lug 28, and will be the number of containers packaged in the carton.

When the support plate 26 is raised, the containers C are lifted into the path of travel of a flight bar 30 which pushes the containers downstream. The flight bar 30 may be supported at its ends by two endless chains, indicated schematically at 32, to form a flight bar conveyor in a manner well known to those in the art. The flight bar conveyor has a very short run, its only function being to move the segregated containers off the support plate to a transfer station located approximately at the upper point of the run of a support carriage conveyor 34.

The conveyor 34 may comprise two spaced endless chains 36 trained over sprockets 38, one of which is powered as by drive belt 40. A number of article support trays or carriages 42 are supported at their sides by the chains 36 and are moved downstream along the upper working surface of the machine by the conveyor 34.

As a support carriage 42 begins to move upwardly toward the article transfer station, a carton blank is transferred to it by the conveyor 44. The conveyor 44 is positioned to receive carton blanks B deposited thereon from the hopper 46 as it begins its upward run from sprocket 48. The endless chains of conveyor 44 may be trained about a sprocket mounted on the same shaft on which sprocket 38 is mounted or a different shaft may be used, depending on the location of elements in the machine and the manner in which the drive trains are desired to be connected.

When an article support carriage 42, carrying a carton blank, reaches the article transfer station, the flight bar 30 pushes the segregated group of containers onto it so that the containers rest on the bottom panel portion of the blank. The support carriage then travels downstream along the upper working surface of the machine. A short distance downstream from the article transfer station leading and trailing folding fingers 50 and 52, respectively, are actuated to fold the tuck flaps 22 in the manner illustrated in FIGS. 1B and 1C, wherein the fingers are shown making the tuck flap folding operation. As soon as the trailing end panel 20 has been elevated substantially vertically by the folding of the tuck flaps, the pusher bar 54 shown at the top of FIG. 2 is actuated. Accordingly, the pusher bar is first shown in the folding sequence of FIG. 1 in FIG. 1C, since it would not have been actuated prior to that time. Once actuated, it remains in its upright pushing position for the remainder of the travel of the carton and the article support carriage downstream of the machine. The folding fingers, on the other hand, remain actuated only for as long as it takes them to complete the tuck flap folding operation. The action of the folding bars or rails, not shown in FIGS. 1 or 2, thereafter complete the folding operation. It is to be understood that the folding fingers must be inactivated in order to remove them from the folding area so as not to interfere with the action of the folding rails. Consequently, the folding fingers 50 and 52 are shown only on the first article support carriage of FIG. 2, not on the carriages downstream therefrom.

Figure 3A:
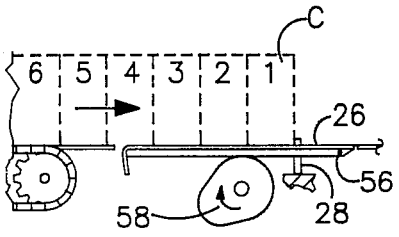
FIGS. 3A to 3C are sequential partial side elevations showing the manner in which the incoming containers are segregated.

Referring to FIG. 3A, it can be seen that the movable support plate 26 is hinged at 56 and that the underside of the plate is in contact with an eccentric cam 58. The first container C in the stream of incoming containers has been stopped by the lugs 28, which extends upwardly through a slot in the plate, and the first three containers in the stream are supported on the plate. Although reference is made for convenience to the first three containers, it should be understood that this can refer also to all the containers in the first three rows of containers extending across the width of the plate 26. The lug 28 in such case would be duplicated as many times as there are rows of containers in order to stop the forward movement of all the containers in a row at the same time. The cam in this view is in its neutral condition, allowing the plate to lie horizontally.

Figure 3B:
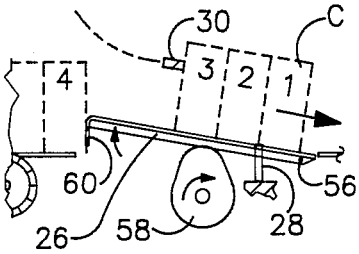

In FIG. 3B the cam has rotated to the point where it has pivoted the plate up about its pivot 56 to allow the flight bar 30 to engage th trailing side of the last container, or the last row of containers as the case may be, to move them downstream toward the transfer station. During this movement the depending lip or flange 60 on the upstream end of the plate 26 engages the new leading container in the row and prevents it from moving.

Figure 3C:
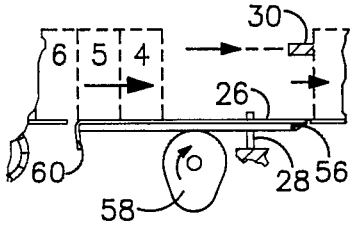

In FIG. 3C the cam 58 has again permitted the plate 26 to return to its horizontal position and the forward feed of the incoming containers continues again toward the stop lug 28. In the meantime the flight bar 30 is pushing the group of containers downsteam toward the transfer station. Although a simple cam arrangement has been shown for controlling the motion of the support plate, obviously other specific arrangements could be employed if desired.

Figure 4A:
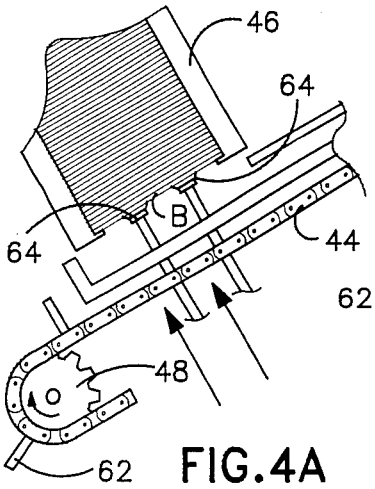
FIGS. 4A to 4C are sequential partial side elevations showing the manner in which the carton blanks are fed to the machine.

Referring to FIG. 4A, the conveyor 44, comprising spaced endless chains 44 traveling over sprocket 48, carries spaced upstanding lugs 62, only one of which is shown. Vacuum cups 64 have been reciprocated to the position shown to engage the bottom blank B in the hopper 46. The reciprocating movement of the rods on which the vacuum cups are mounted can be carried out by any convenient means, such as by a crank and lever arrangement well known in the art.

Figure 4B:
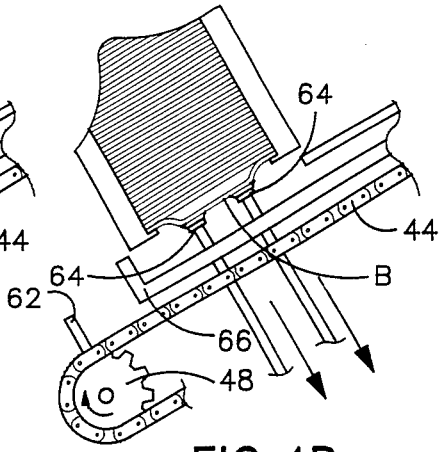
Figure 4C:
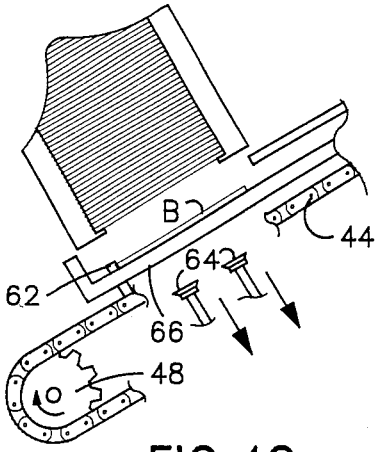

In FIG. 4B the vacuum cups have begun to move away from the hopper 46, pulling with them the lowermost blank B. The lug 62 has moved closer to the blank support means in this view. In FIG. 4C the blank B is shown after it has been deposited on the support 66 by the vacuum cups and the lug 62 is just ready to engage the trailing edge of the blank to begin pushing it upwardly toward the point at which the blank is transferred to the article support carriage. Obviously other arrangements could be used if desired, so long as a blank can be removed from the hopper and transferred to the conveyor 44 in a dependable manner.

Figure 8A:
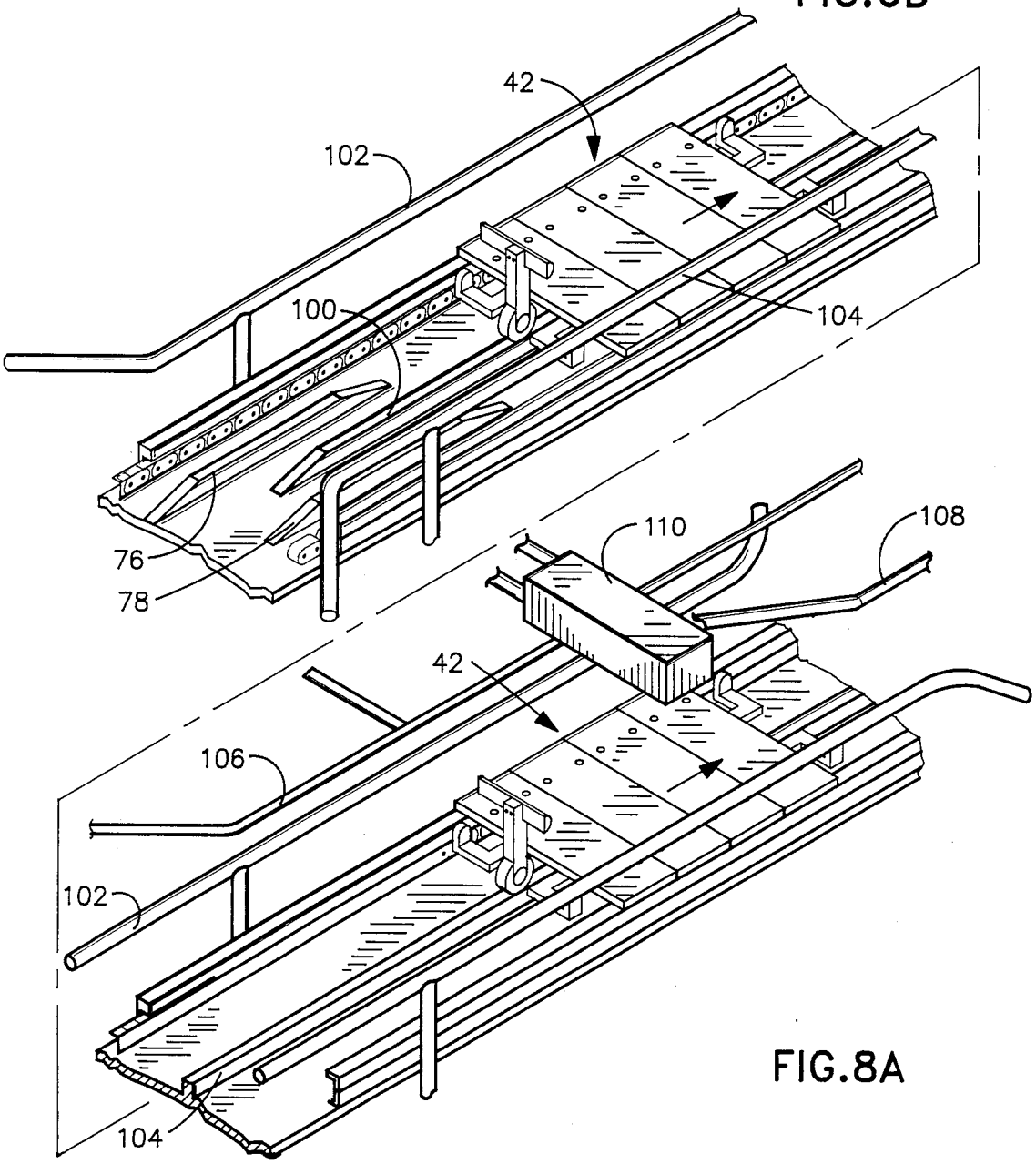
FIGS. 8A and 8B are pictorial representations of the machine support surface, the article support carriage and the carton blank folding rails along the length of the machine.

Referring to FIGS. 5A, 5B, 7 and 8A, the article support carriage 42 comprises a plurality of plates 70 attached at their ends to the conveyor chains 36. Extending up from the trailing end of the trailing plate 70 near each side edge of the plate is a small flange or lug 72 which engages and pushes against the trailing edge of the carton blank to ensure positive movement of the blank and to fix it in position for the folding tuck fingers. The trailing fingers 52 are attached to a cam follower 74 which is mounted to engage stationary cam 76. As shown in FIG. 8A, the cam 76 is fixed in position at the far side of the machine surface and the cam follower 74 is located on that side of the carriage so as to engage the cam. The cam 76 is located farther upstream on the machine than the cam 78, which is positioned on the near side of the machine for engagement with the cam follower 80 associated with the leading folding fingers 50. This is done in order to have the leading and trailing folding fingers actuated at substantially the same time so that the tuck flaps can be folded substantially simultaneously. It can be seen, with reespect to the trailing fingers 52, that when their associated cam follower 74 rides up the ramp of the cam 76 the raising of the cam follower rotates the shaft 80 to which the cam follower is connected by arm 82. This causes the trailing folding fingers 52 to be pivoted in a clockwise direction to engage the trailing tuck flaps.

Figure 7:
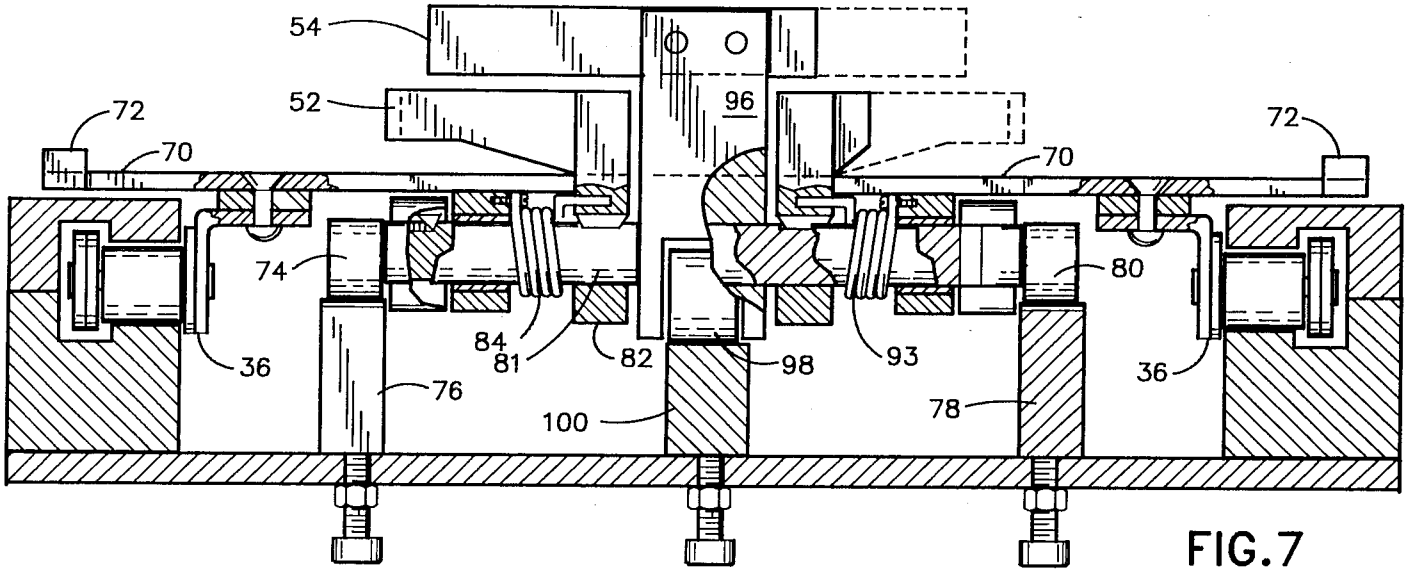
FIG. 7 is a section taken through the machine support surface and through portions of the article support carriage, showing in back elevation the pusher arm and the trailing folding fingers in their raised position.

As shown in FIG. 7, where the far side cam 76 is shown on the left of the drawing, the association of elements described above is depicted more clearly. In addition, spring 84 is shown to bias the finger 52 toward its inactivated position so that when the cam follower 74 rides down off the cam 76, the folding finger 52 returns to the position depicted in FIG. 5A.

Figure 5A:
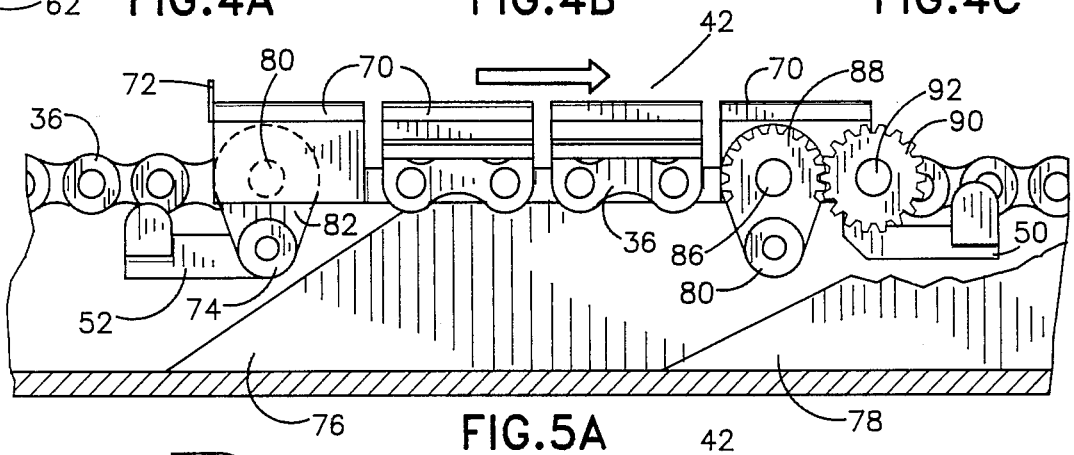
FIGS. 5A and 5B are enlarged side elevations of the article support tray or carriage, showing it as it approaches the cams that actuate the tuck flap folding fingers and after the cams have actuated the folding fingers.
Figure 5B:
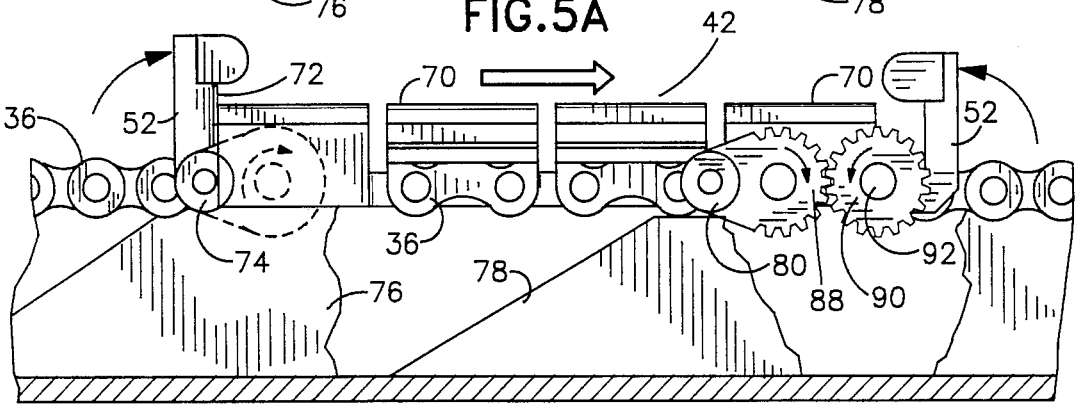

When the near side cam 78, shown in FIGS. 5B, 7 and 8A, causes the cam follower 80 associated with the leading folding finger 50 to move up onto it, the shaft 86 is caused to rotate in a clockwise direction. This causes the gear 88 attached to the shaft 86 to rotate in the same direction and the meshing gear 90, mounted on shaft 92, to rotate in the counterclockwise direction. This causes the leading folding finger 50 to rotate back about shaft 92 against the bias of the spring 93 to fold the leading tuck flaps in.

Figure 6A:
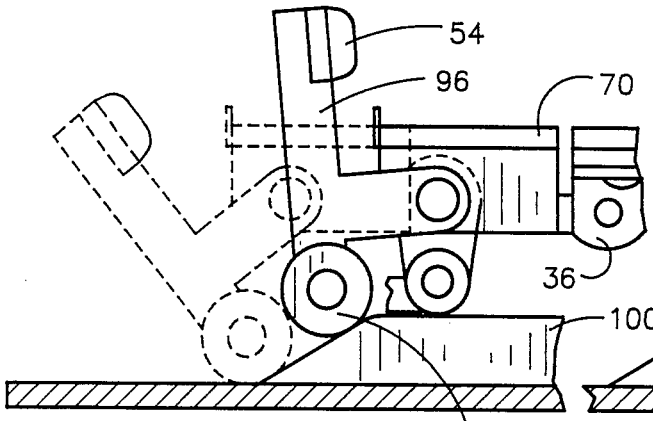
FIGS. 6A and 6B are enlarged partial side elevations of the article support carriage, showing the trailing end of the carriage as it approaches the cam that actuates the article pusher arm and after the cam has actuated the pusher arm.
Figure 6B:
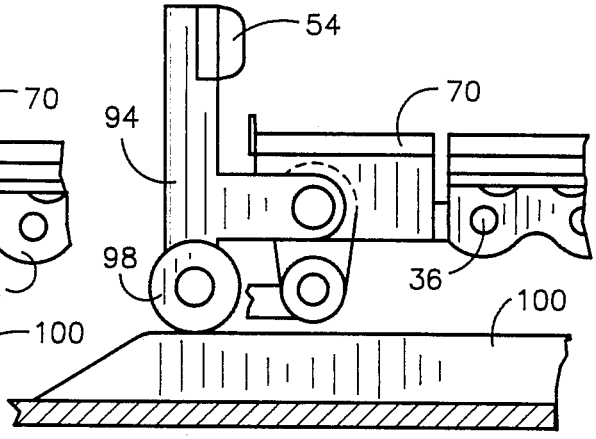

Referring to FIGS. 6A, 6B and 7, the pusher arm 54 is attached by angle arm 96 to cam follower 98 which is adapted to engage cam 100 mounted on the upper machine surface. As shown in FIG. 8A, the cam 100 begins at a point designed to allow the folding fingers to fold up the tuck flaps just before the pusher arm is actuated. Whereas the tucker cams terminate after a short distance to allow the folding fingers to move into inactive position after the tuck flaps have been folded up, the pusher arm cam 100 extends to the end of the machine surface so that the pusher arm is engaged with the containers supported on the carriage throughout the entire passage of the containers through the machine.

As shown in FIG. 7, the pusher arm may be the full width shown in dotted lines to engage rows of containers extending three across, or it may be the narrow width shown in solid lines to engage rows of containers extending only two across. The same arrangement is true of the folding fingers, which would have to be correspondingly narrowed if fewer rows of containers are being packaged.

Figure 8B:
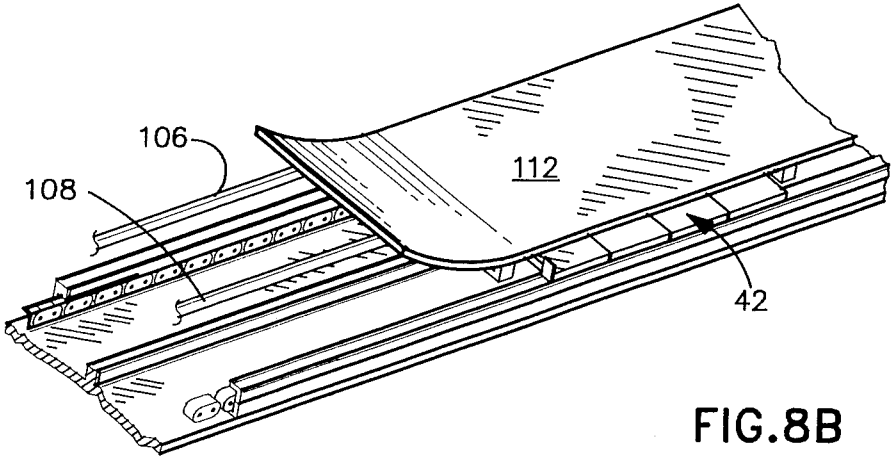

As shown in FIGS. 8A and 8B, the rails 102 and 104 act to fold the side panels upwardly to their final position in a manner well known in the art. The rails 106 and 108 act to fold the inner and outer top panels down, also in the conventional way well known in the art, and the glue gun 110 applies glue on the top of the inner top panel just prior to the outer top panel being folded down, again in a manner well known in the art. After the glue has been applied and the outer top panel folded down, the carton moves beneath the upper plate 112 which holds the panel in place until the glue has set and the carton is adhesively bonded together.

It should now be clear that the present invention accomplishes its goals in a simple straightforward design which provides for positive movement of the containers by the same means which moves the blank. This eliminates the use of an overhead flight bar conveyor which in the prior art has extended the full length of the machine, and leaves the upper surface of the machine open for purposes of maintenance and adjustment.

It should be obvious from the foregoing that although a preferred embodiment of the invention has been described, it is possible to make changes to certain specific details of the machine without departing from the spirit and scope of the invention.

What is claimed is:

1. Apparatus for packaging a plurality of articles in a wrap-around carton having a bottom panel, side panels foldably connected to the bottom panel, an inner top panel foldably connected to one of the side panels, an outer top panel foldably connected to the other side panel, and end panels foldably connected to the bottom panel, the end panels and the side panels being foldably connected by tuck flaps, the apparatus being adapted to receive articles at its upstream end from an infeed conveyor, the apparatus comprising:

means for segregating a predetermined number of articles fed to the upstream end of the apparatus;

article support means mounted for movement in a downstream direction;

means for introducing a carton blank to the article support means so that the carton blank is supported thereon;

means for moving the segregated articles to the article support means and loading the articles onto the support means so that the articles rest directly on the portion of the carton blank designed to be the bottom of the carton;

means for moving the article support means in a downstream direction, the side and top panels of the blank extending to the side of the article support means, one of the end panels extending in a downstream direction and the other end panel extending in an upstream direction;

means attached to and carried by the article support means for folding the leading and trailing tuck flaps of the carton blank toward each other to elevate the side and end panels while the article support means is moving downstream;

means on the article support means for pushing against the trailing faces of the articles while the article support means is moving downstream; and means for folding and securing the side and top panels in place to complete the forming of the carton.

2. Apparatus according to claim 1, wherein the means for moving the segregated articles to the article support means comprises a flight bar conveyor carrying a flight bar which pushes the trailing faces of the segregated articles along a support surface.

3. Apparatus according to claim 1, wherein the means for introducing a carton blank to the article support means comprises an endless chain carrying lugs which engage the trailing edge of the blank to push the blank along its path of movement.

4. Apparatus according to claim 1, wherein the means for segregating a predetermined number of articles comprises a hinged plate, the free end of which faces upstream and generally forms a continuation of the surface over which the incoming articles are moving, means for stopping the infeed of the articles when a predetermined number of articles are supported on the hinged plate, and means for pivoting the hinged plate upwardly to place the segregated articles in position to be moved to the article support means.

5. Apparatus according to claim 4, wherein the means for stopping the infeed of the articles comprises lug means extending upwardly intermediate the length of the hinged plate so that the leading articles in the stream of incoming articles strike the lug means and are stopped thereby, the upward pivoting of the hinged plate lifting the articles above and out of engagement with the lug means.

6. Apparatus according to claim 5, wherein the lug means extend upwardly through a slot in the hinged plate.

7. Apparatus according to claim 4, wherein the means for pivoting the hinged plate comprises cam means.

8. Apparatus according to claim 1, wherein the article support means includes upstanding lugs at the trailing portion thereof for engaging the trailing edge of the carton blank.

9. Apparatus according to claim 1, wherein the means on the article support means for folding the tuck flaps of the carton blank comprises tuck fingers pivotally mounted on the article support means beneath the tuck flaps of the carton blank, and cam means for pivoting the tuck fingers upwardly to engage the underside of the tuck flaps and fold the leading and trailing tuck flaps toward each other.

10. Apparatus according to claim 9, wherein the cam means comprises cam followers associated with the tuck fingers and stationary cams positioned along the path of movement of the cam followers to actuate the pivoting movement of the tuck fingers, the tuck fingers being spring biased toward their inactive position.

11. Apparatus according to claim 1, wherein the means for pushing against the trailing faces of the articles comprises a pusher arm pivotally mounted on the article support means beneath the trailing end flap of the carton blank, the pusher arm being cam actuated to pivot upwardly and engage the trailing faces of the articles.

12. Apparatus according to claim 11, wherein the pivoting motion of the pusher arm is caused by cam means comprising a cam follower associated with the pusher arm and a stationary cam positioned along the path of movement of the cam follower.

13. Apparatus according to claim 1, wherein the article support means comprises a support tray attached to and mounted between endless chains which move the support tray downstream.

* * * * *